US011661244B2

(12) United States Patent
Bruder et al.

(10) Patent No.: US 11,661,244 B2
(45) Date of Patent: May 30, 2023

(54) LIQUID DISPENSER HAVING COMPRESSIBLE LIQUID STORE

(71) Applicant: Aptar Radolfzell GmbH, Radolfzell (DE)

(72) Inventors: Thomas Bruder, Constance (DE); Michael Hoer, Meerbusch (DE); Francis Moreau, Sotteville-lès-Rouen (FR)

(73) Assignee: APTAR RADOLFZELL GMBH, Radolfzell (DE)

( * ) Notice: Subject to any disclaimer, the term of this patent is extended or adjusted under 35 U.S.C. 154(b) by 17 days.

(21) Appl. No.: 17/052,340

(22) PCT Filed: Mar. 14, 2019

(86) PCT No.: PCT/EP2019/056444
§ 371 (c)(1),
(2) Date: Nov. 2, 2020

(87) PCT Pub. No.: WO2019/211032
PCT Pub. Date: Nov. 7, 2019

(65) Prior Publication Data

US 2021/0237940 A1 Aug. 5, 2021

(30) Foreign Application Priority Data

May 3, 2018 (EP) ..... 18170634

(51) Int. Cl.
*B65D 35/46* (2006.01)
*B65D 47/08* (2006.01)
*B65D 47/20* (2006.01)

(52) U.S. Cl.
CPC ..... *B65D 35/46* (2013.01); *B65D 47/0828* (2013.01); *B65D 47/2081* (2013.01)

(58) Field of Classification Search
None
See application file for complete search history.

(56) References Cited

U.S. PATENT DOCUMENTS 1,987,156 A 1/1935 Paparello
3,144,964 A 8/1964 Goff et al.
(Continued)

FOREIGN PATENT DOCUMENTS

DE 2318954 11/1973
DE 29709328 U1 9/1997
(Continued)

OTHER PUBLICATIONS

Chinese Office Action issued in corresponding Chinese Application No. 201980030094.8 dated Oct. 20, 2021 (7 pages).
(Continued)

*Primary Examiner* — Jeremy Carroll
(74) *Attorney, Agent, or Firm* — Flynn Thiel, P.C.

(57) ABSTRACT

Cream dispenser for topically dispensing liquid onto the skin of a user including a liquid store, a discharge head that has a discharge opening and a hinged lid to protect the discharge opening. The dispenser has a multi-part design of the discharge head in order to limit, in a haptically satisfactory way, the movability of a release button of the discharge head and a special relative arrangement of the locking edges on the discharge head and on the hinged lid opposite a joint of the hinged lid in order to prevent the sharp-edged locking edges from coming into contact with the skin while cream is being discharged onto the skin.

21 Claims, 3 Drawing Sheets

(56) References Cited

U.S. PATENT DOCUMENTS

| | | | | |
|---|---|---|---|---|
| 4,060,179 | A | 11/1977 | McGhie | |
| 5,143,236 | A * | 9/1992 | Gueret | B65D 51/165 215/276 |
| 5,246,145 | A | 9/1993 | Leoncavallo et al. | |
| 7,195,138 | B2 | 3/2007 | Foster et al. | |
| 7,275,665 | B2 | 10/2007 | Young | |
| 7,328,820 | B2 * | 2/2008 | Young | B65D 47/0838 220/717 |
| 8,534,509 | B2 | 9/2013 | Duquet | |
| 9,757,749 | B2 | 9/2017 | Bloc | |
| 10,137,466 | B2 | 11/2018 | Bruder et al. | |
| 2003/0132240 | A1 | 7/2003 | Gueret | |
| 2003/0189065 | A1 | 10/2003 | Stull et al. | |
| 2007/0093765 | A1 | 4/2007 | Kawashiro et al. | |
| 2012/0080449 | A1 | 4/2012 | Lehmkuhl et al. | |
| 2013/0193170 | A1 * | 8/2013 | Lehmkuhl | B65D 51/1644 222/494 |
| 2017/0234446 | A1 | 8/2017 | Maloney et al. | |
| 2018/0148234 | A1 * | 5/2018 | Knight | B65D 51/1683 |
| 2019/0023463 | A1 * | 1/2019 | Knight | B65D 47/2081 |

FOREIGN PATENT DOCUMENTS

| | | | | |
|---|---|---|---|---|
| DE | 10157423 | A1 | 6/2003 | |
| DE | 202004012821 | U1 | 1/2006 | |
| DE | 102013214227 | A1 | 1/2015 | |
| DE | 102013214227 | B4 * | 11/2016 | B65D 35/46 |
| EP | 0253495 | A2 | 1/1988 | |
| EP | 2923964 | A1 | 9/2015 | |
| EP | 3050817 | A1 | 8/2016 | |
| FR | 996343 | | 12/1951 | |
| FR | 2616756 | A1 | 12/1998 | |
| FR | 2856984 | A1 | 1/2005 | |
| GB | 2122585 | A | 1/1984 | |
| KR | 1020120032739 | A | 4/2012 | |
| KR | 2020140005234 | U | 10/2014 | |
| WO | WO-9526306 | A1 * | 10/1995 | B65D 47/2081 |
| WO | 9964313 | A1 | 12/1999 | |
| WO | 0174687 | A1 | 10/2001 | |
| WO | 2004094239 | A2 | 11/2004 | |
| WO | 2007024404 | A1 | 3/2007 | |
| WO | 2008048160 | A1 | 4/2008 | |
| WO | 2012059691 | A1 | 5/2012 | |

OTHER PUBLICATIONS

Korean Office Action issued in corresponding Korean Application No. 10-2020-7034721 dated May 30, 2022 (9 pages).

Written Opinion of International Searching Authority with English Translation issued in corresponding International Application No. PCT/EP2019/056444 dated Jun. 19, 2019 (18 pages).

European Search Report issued in corresponding European Application No. 18170634.2, dated Sep. 5, 2018 (9 pages).

International Search Report with English Translation issued in corresponding International Application No. PCT/EP2019/05644 dated Jun. 19, 2019 (11 pages).

Chinese Decision on Rejection issued in corresponding Chinese Application No. 201980030094.8, dated Dec. 16, 2022 (6 pages).

Korean Office Action issued in corresponding Korean Application No. 10-2020-7034721, dated Dec. 26, 2022 (4 pages).

* cited by examiner

LIQUID DISPENSER HAVING COMPRESSIBLE LIQUID STORE

FIELD OF APPLICATION AND PRIOR ART

The invention relates to a cream dispenser for dispensing liquids typically on the skin of a user. Dispensers of this type are used in the cosmetic and pharmaceutical sectors.

Cream dispensers of the generic type as well as cream dispensers according to the invention are typically configured as tube dispensers and, apart from the typically integral tube body, also comprise a plastics-material delivery head which is attached to the latter and has a delivery opening. The delivery head, for the purposes of avoiding drying-out and/or improving the standing capability of the dispenser, has a hinged lid which in the closed state covers a delivery opening.

A multiplicity of such cream dispensers of the generic type are known from the prior art. There nevertheless continues to be a demand for guaranteeing a high degree of comfort in terms of activation and a pleasant user experience at low production costs.

OBJECT AND ACHIEVEMENT

It is an object of the invention to make available a cream dispenser which is able to be produced in a cost-effective manner and which is distinguished by an operation and use which is pleasant in haptic terms.

To this end, according to a first aspect of the invention, a cream dispenser for dispensing liquid on the skin of a user is proposed according to the invention, said cream dispenser possessing a liquid reservoir having an outlet port, as well as a delivery head having an outlet duct and a delivery opening at the end of the outlet duct. The delivery head comprises an outlet valve having a valve pressure chamber, the outlet valve being able to be opened by the internal pressure of said valve pressure chamber.

A cream dispenser according to the invention is configured for dispensing highly viscous liquids, for example, cream-type or gel-type substances. The liquid reservoir of the dispenser according to the invention is accordingly filled with such a liquid, wherein this liquid can be a cosmetic liquid or a liquid effective as a pharmaceutical, or a hybrid liquid having both a cosmetic and a pharmaceutical purpose.

It is proposed that the delivery head comprises in particular two components, specifically an internal component and an external component. The external component has an end wall which is penetrated by the outlet duct and in which the delivery opening is provided. The internal component, for connecting to the outlet port of the liquid reservoir, comprises a connector port which extends in a direction of main extent (or longitudinally) of the dispenser. The internal component furthermore has a valve face which is disposed opposite an entry of the outlet duct, wherein the valve face and the entry of the outlet duct conjointly form the outlet valve and are mutually adapted in such a manner that the outlet valve can be opened and closed by repositioning the valve face and the outlet duct relative to one another. The internal component and the external component, along an encircling fastening region on an internal side of a casing face of the external component, are fixedly and tightly connected to one another so as to form a valve pressure chamber.

The internal component and the external component thus conjointly define the valve pressure chamber into which liquid from the liquid reservoir, in particular the tube, is squeezed. The rising pressure leads to the mutually opposite walls on the internal component and the external component becoming spaced apart, thus causing the valve to open. The cream can now exit in a metered manner through the delivery opening in the end wall. The cream thus particularly preferably reaches a planar external side of the end wall, from where the cream is applied to the skin of the user. The external side is therefore preferably free of sharp edges as the latter are considered unpleasant when in contact with the skin.

The delivery head comprises a hinged lid which in a closed state covers the delivery opening. The hinged lid on one side is provided with an articulation and opposite thereto is configured so as to have a first latching edge for fixing in a closing manner on the external component. The hinged lid herein is preferably an integral part of the external component. A substantially immovable part of the external component, conjointly with the internal component, forms a base of the delivery head, and the hinged lid has a movable part molded so as to be integral with the external component.

A release button is provided with a second latching edge and is provided on the immovable part of the external component. The second latching edge, in the case of a closed hinged lid, latches with the first latching edge on the hinged lid and via depression of the release button is releasable from this latching action such that the hinged lid can be opened.

The fastening region in which the internal component is fastened to the external component, in terms of the direction of main extent of the dispenser, is disposed so as to be level with the release button such that the release button when activated is moved in the direction of the fastening region.

The user depresses the release button in order for the hinged lid to be opened. It is desirable herein that such an activation runs smoothly in a comfortable manner without there being the risk of the release inadvertently taking place.

It is furthermore desirable that the depressing capability of the release button is delimited in a defined manner. This is achieved according to the invention in that the release button is moved in the direction of the fastening region. This fastening region of the delivery head has a high degree of stability since the internal component and the external component are connected to one another in this region. The mechanical coupling of the internal and external components reinforce this region. Additionally, the construction mode of the internal component as well as the choice of material for the latter can guarantee a particularly stable construction.

The release button is thus able to be depressed only to a limited extent until said release button is pushed against the stable fastening region and cannot be moved any further. This clear delimitation of the mobility is considered to be appealing in haptic terms and reduces the risk of the release button being accidentally broken off.

The external component and the internal component in the fastening region are preferably tightly connected by way of a snap-fit connection. One of the components, in particular the external component, to this end has an encircling groove into which an encircling web of the other component, in particular an external periphery of the internal component, is fixedly snap-fitted in a sealing manner.

The internal component preferably comprises an annular portion which extends transversely to the direction of main extent, and the external circumference of the annular portion in the fastening region is fixedly and tightly connected to the external component. This annular portion has a radial direction of extent which is counter to the depressing force acting on the release button, and thus has a particularly positive stiffening effect.

The external component is preferably made from a rather soft plastics material since this is advantageous in terms of the function of the articulation, in terms of the deformation capability of the release button, as well as in terms of the resilience of the end wall which is considered pleasant. In contrast, the internal component can be produced from a material which is more rigid and less elastic than that of the external component. This facilitates the assembly and simultaneously enhances the stiffness of the fastening region.

Alternatively or additionally, the internal component, at least in the region of the annular portion thereof, has a greater wall thickness than an end wall of the external component that, conjointly with the internal component, delimits the valve pressure chamber. This also enhances the flexibility of the end wall and the stiffness of the fastening region.

The internal component particularly preferably has a substantially flat area portion, the connector port rising from one side of the flat area portion and the external region of the latter forming the annular portion. The flat area portion on the opposite side thereof from the connector port is preferably provided with the valve face and at least one liquid passage. The internal component thus preferably has a fundamentally flat shape, only the connector port and optionally a structure which forms the valve face of the internal component rising from the fundamentally flat shape.

The release button can in particular be designed as a release tongue which is elastically molded on one side of the external component, the latching edge being provided on the distal end of said release tongue. It is preferably provided herein that the release button is separated from the surrounding casing face of the external component by a slot. This separation, by way of a slot in the case of the release button being linked only on one side to an at least partially surrounding casing wall, allows depression of the release button to be smooth. By virtue of the detent in the fastening region there is nevertheless no risk of the release button breaking off.

The hinged lid is preferably shaped in such a manner, or provided with an articulation of such a type, that the hinged lid in the closed state is biased and automatically springs open when there is pressure on the release button. Such a bias is advantageous, on the one hand, since the release button alone is sufficient for getting the dispenser to a delivery-ready state without the hinged lid having to be manually moved, in particular preferably pivoted by 180°, to the terminal position of said hinged lid. The bias is however furthermore advantageous since the bias keeps the latching connection between the hinged lid and the release button under tension. Despite the intended smooth running of the release button per se, any unintentional depressing of the release button is precluded.

In order to enable the hinged lid to spring open in an ideally complete manner, the articulation for linking the hinged lid is preferably conceived such that the articulation in the closed state is under tension, the latter relaxing in the course of the opening.

It is also particularly advantageous, in terms of the hinged lid springing open in a reliable self-acting manner, for the hinged lid to be under tension in the region of bearing contact with the end wall of the external component. The internal side of the hinged lid bearing on the end wall of the external component is already advantageous in terms of closing the delivery opening. On account of tension which thus is present in the end wall or the hinged lid, the opening is also facilitated in the manner described.

The hinged lid can in particular have a cover wall which covers the end wall of the external component. The side that points inward forms a closure face which is bulged in the direction of the delivery opening and, on account thereof, the cover wall in the closed state bears with bias on the end wall so as to surround the delivery opening.

The cover wall to this end has a size which preferably exceeds that of the end wall. The cover wall, at least on the internal side in the region of the closure face, particularly preferably however internally and externally, is configured so as to be free of additional structures such as elevations or depressions, and thus deviates from a completely flat shape only by way of the bulge in the direction of the delivery opening.

On account thereof, the internal side that forms the closure face is easy to be relieved of the remnants of liquids. An encircling casing wall, on which the articulation and the latching edge proximal to the hinged lid are provided, preferably adjoins the cover wall externally.

The fastening region which, in the manner mentioned above facilitates the stability of the delivery head, in terms of the direction of main extent, is formed by the region in which the internal component and the internal side of the external component bear on one another and, on account thereof, achieve a fixed and liquid-tight connection.

The release button, in terms of the direction of main extent, preferably extends on both sides of this fastening region. The release button originates at the liquid reservoir and extends beyond the fastening region. Alternatively, the release button can, however, also be provided that the end of the release button that points away from the liquid reservoir and/or the latching edge on the release button extend/extends only up to the fastening region but not beyond the latter.

According to a further aspect of the invention, a cream dispenser for topically dispensing liquid on the skin of a user is proposed, the cream dispenser possessing a liquid reservoir having an outlet port and a delivery head having an outlet duct and a delivery opening at the end of the outlet duct. This delivery head has an end wall which is penetrated by the outlet duct and in which the delivery opening is provided.

The delivery head comprises a hinged lid which in a closed state closes the delivery opening. The hinged lid on an internal side herein has a bulged closure face, the size of the latter being larger than the cross-sectional area of the delivery opening, wherein the bulged closure face in the closed state of the hinged lid, in the region of an annular contact face that surrounds the delivery opening, bears on the end wall.

The bulged closure face on account thereof additionally closes the delivery opening and can additionally somewhat depress the end wall so as to effectively preclude an outlet valve of the delivery head being opened. The bulge is preferably achieved in that the cover wall in its entirety is bulged in the region of the closure face such that the external side that is opposite the closure face also has this bulge. The cover wall in this instance preferably has a uniform (+/−10) wall thickness. Alternatively, however, designs in which the closure face per se, but not the opposite external side of the hinged lid, is bulged are also possible. In this case, the wall thickness in a centric region of the closure face is preferably greater than in a peripheral region of the closure face or than in an annular region that surrounds the closure face.

The closure face may be formed only by partial regions of the internal side of the end wall which are bulged convexly when seen from the perspective of the delivery opening, thus by a face which is opposite the delivery opening and in the closed state bulges in the direction of delivery opening. The curvature radius herein, at least in the region of the annular contact face, is comparatively large, the curvature thus being minor. The curvature radius at least in the region of the annular contact face, preferably however in terms of the entire closure face, herein is in particular between 4 cm and 25 cm, preferably between 6 cm and 15 cm. These values relate to the open state of the hinged lid, and thus exclude any deformation caused by the closed state.

The curvature has the effect that the contact face between the closure face and the end wall is minor such that a comparatively high contact pressure per unit area is achieved. The annular contact face in the radial direction in terms of the delivery opening preferably has a width of less than 0.8 mm, in particular of less than 0.4 mm. The comparatively small contact face facilitates the tightness. Even if liquid under intense and unintentional pressure on the liquid reservoir can actually exit through the delivery opening in the case of a closed hinged lid, the liquid only reaches this annular contact face. This liquid can later be very easily removed by virtue of the internal side of the hinged lid being preferably free of edges.

The closure face is larger than the delivery opening so as to enable the delivery opening to bear in a surrounding manner on the end wall. The closure face is particularly preferably at least 20% larger, preferably at least 40% larger, than the cross-sectional area of the delivery opening, in order for the closure face in its entirety not to invade the delivery opening but to in any case protrude beyond the periphery of the latter.

The closure face, which is formed by a convexly bulged part of the internal face of the end wall of the hinged lid, is preferably even significantly larger. The closure face particularly preferably forms the entire internal face on the internal side of a surrounding lid periphery, or almost the entire internal face. This means that at least 80% of the internal side of the cover wall is preferably formed by the bulged closure face. The curvature radius on this at least 80% of the internal side of the cover wall is preferably without exception in the above-mentioned range between 4 cm and 25 cm, and particularly preferably between 6 cm and 15 cm.

The bulged closure face being completely formed in such a way by the internal side of the cover wall leads to the entire internal side being very easy to clean since the internal side, by virtue of the mentioned curvature radius range, does not have any kind of steps or cracks which are difficult to clean.

A design of the hinged lid in which the entire cover wall, or almost the entire cover wall, on the internal side forms the bulged closure face and where the wall thickness is uniform (+/−10%) permits in particular a uniform tension in the hinged lid in the closed state such that the hinged lid, proceeding from the closed state, when the hinged lid is released, for example by way of the release button already described, springs to a position which completely releases the end wall.

A further aspect of the invention relates to the attachment of the hinged lid to the base of the delivery head. All above-mentioned measures can be additionally provided in a mutually independent manner herein.

According to this further aspect of the invention a cream dispenser for dispensing liquid on the skin of a user is proposed, the cream dispenser possessing a liquid reservoir having an outlet port as well as a delivery head having an outlet duct and a delivery opening at the end of the outlet duct. This cream dispenser is in particular designed according to the manner described above.

The delivery head, with the exception of a minimal movement for opening a valve or for depressing the release button, has a substantially immovable base. The base, for connecting to the liquid reservoir, comprises a connector port which extends in a direction of main extent and furthermore comprises an end wall which is penetrated by the outlet duct and in which the delivery opening is provided. A delivery of liquid initially takes place to the external side of the end wall and the liquid from there is then applied to the skin of the user.

The formation of the delivery head having an internal component and an external component is not primarily relevant in this aspect of the invention. Nevertheless, the base is preferably likewise constructed from these two parts.

The delivery head according to this further aspect likewise comprises a hinged lid which in the closed state covers the delivery opening and the end wall and which by means of an articulation is articulated so as to be pivotable on the base. Interacting latching edges are provided so as to be opposite the articulation on the base and the hinged lid, by means of which latching edges the hinged lid in the closed state can be latched on the base. The latching edge on the base and the articulation, in terms of the direction of main extent, are disposed so as to be mutually offset such that the latching installation on the hinged lid in the completely pivoted-open state, in terms of the direction of main extent, is more remote from the delivery opening than in the closed state of the hinged lid.

The hinged lid, which can have all aspects which have been described above in the context of the first aspect of the invention, is preferably pivotable by approximately 180° (+/−20°) between the closed position and the maximum pivoted position. The articulation, and in particular the pivot axis defined by the articulation, on the one hand, and the latching edge for latching on the base, on the other hand, are mutually offset in terms of the direction of main extent.

This offset leads to the latching edge of the hinged lid with a swung-open hinged lid being recessed particularly far in relation to an end wall of the base. This is advantageous in terms of a pleasant use, since cream which has initially been delivered to the end wall of the base from the latter can be applied on the skin of a user, and the risk of the comparatively sharp-edged latching edge of the lid inadvertently also coming in contact with the skin is reduced.

The latching installation on the base and the articulation in terms of the direction of main extent are preferably disposed to as to be mutually offset by at least 3 mm, preferably by at least 5 mm.

In order for the desired effect, i.e. the ideally large spacing of the latching edge on the lid from the plane of the end wall of the base in the swung-open state, to be reinforced, the articulation and the pivot axis defined by the latter in terms of the direction of main extent are disposed so as to be as close as possible to the liquid reservoir. The spacing from an end of a casing face of the delivery head pointing in this direction is preferably 5 mm or less. It is furthermore advantageous for the latching edge of the base, in terms of the main direction of extent, to be as remote as possible from the liquid reservoir. It is considered advantageous for the latching edge to be only slightly recessed, particularly by less than 3 mm, from the external face of the end wall. However, the spacing should ideally not be less than 1 mm in order for the latching edge of the base not to come into contact with the skin when cream is applied on the skin.

A bearing edge, on which an encircling casing face of the hinged lid bears in the closed state, is preferably provided on both sides on the external side of the external component. The bearing edges herein are configured as edges which gradually rise from the articulation toward the latching installation.

BRIEF DESCRIPTION OF THE DRAWINGS

Further advantages and aspects of the invention are derived from the claims and from the description hereunder of preferred exemplary embodiments of the invention that will be explained hereunder by means of the figures in which:

DETAILED DESCRIPTION OF THE EXEMPLARY EMBODIMENTS

The figures highlight the construction of a cream dispenser according to the invention.

Figure 1:
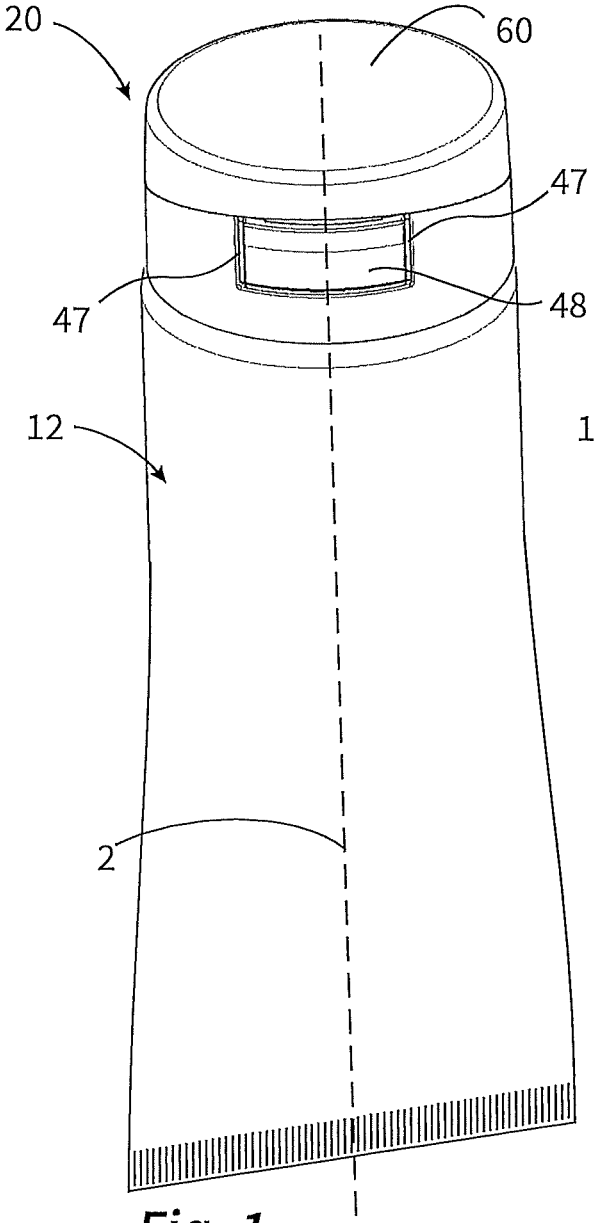
FIG. 1 shows a cream dispenser according to the invention in an overall illustration.

FIG. 1 shows the cream dispenser 10 in the shipped state. The cream dispenser 10 comprises a liquid reservoir 12 which presently is configured as a tube and thus is provided for activation by manually impinging the external faces with pressure. In principle, however, other concepts are also conceivable, for example having a repositionable piston which at the end side is pushed into the liquid reservoir in order to convey liquid out of the latter.

A delivery head 20 is attached to the liquid reservoir 12, for example by means of a threaded connection or a snap-fit connection. The delivery head comprises a base which when in operation remains so as to be substantially immovable in relation to the liquid reservoir, and a hinged lid 60 which in the closed state covers a delivery opening 44 and can be unlatched and opened by means of a release button 48.

Figure 2:
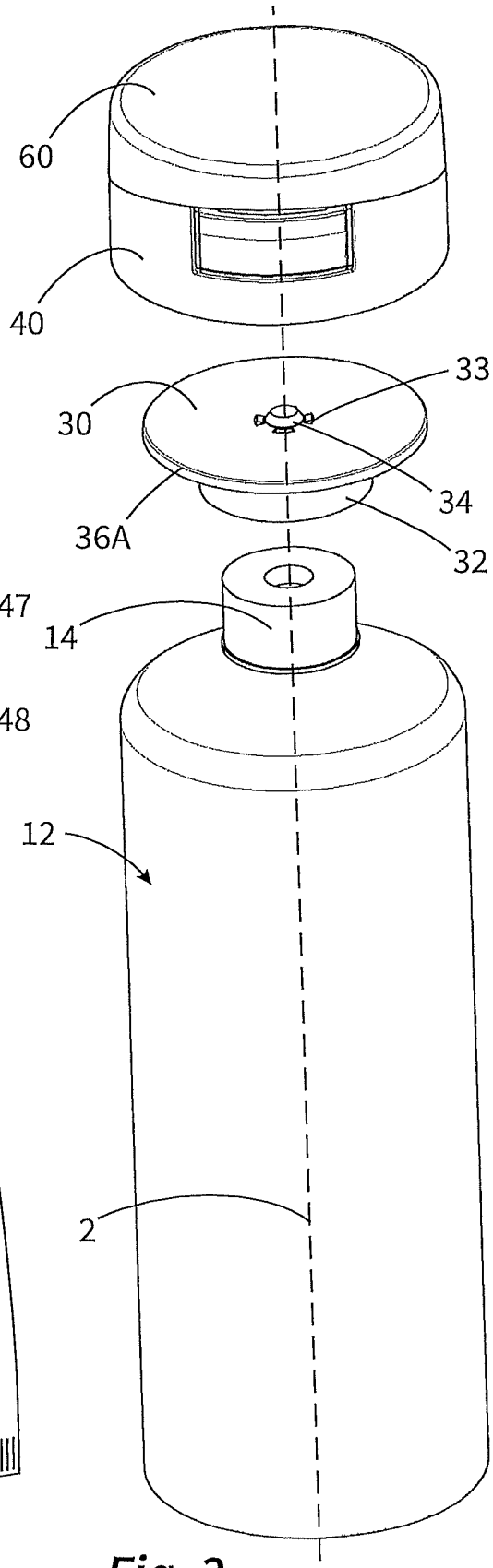
FIG. 2 shows an exploded illustration of the cream dispenser according to FIG. 1.

FIG. 2 shows the individual component parts of the cream dispenser 10. The liquid dispenser 12 in the state of FIG. 2 is still situated in the unfilled state and at the lower end thereof that is opposite an outlet port 14 is therefore not yet closed.

As is highlighted in FIG. 2, the delivery head 20 has two components 30, 40, specifically an internal component 30 and an external component 40. The internal component herein is configured so as to have thicker walls and/or from a stiffer material, forming the less deformable one of the two components 30, 40.

The internal component 30 in the assembled state is fixedly connected to the external component 40. The internal component 30 furthermore has a connector port 32 which is configured for coupling to the outlet port 14 of the liquid dispenser 12 by means of a threaded connection or a snap-fit connection. The outlet port 14 in the illustrations is illustrated in a simplified manner, without a thread or a snap-fit edge.

The detailed construction of the delivery head and of the two components 30, 40 can be derived from the following figures.

Figure 3A:
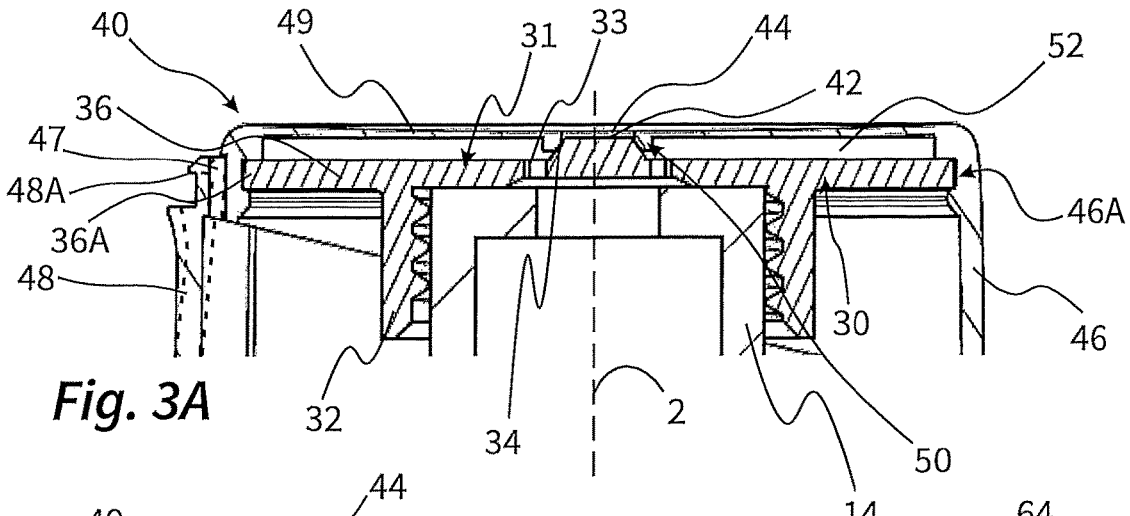
FIGS. 3 and 3A show the cream dispenser in a sectional illustration with the lid opened.
Figure 3:
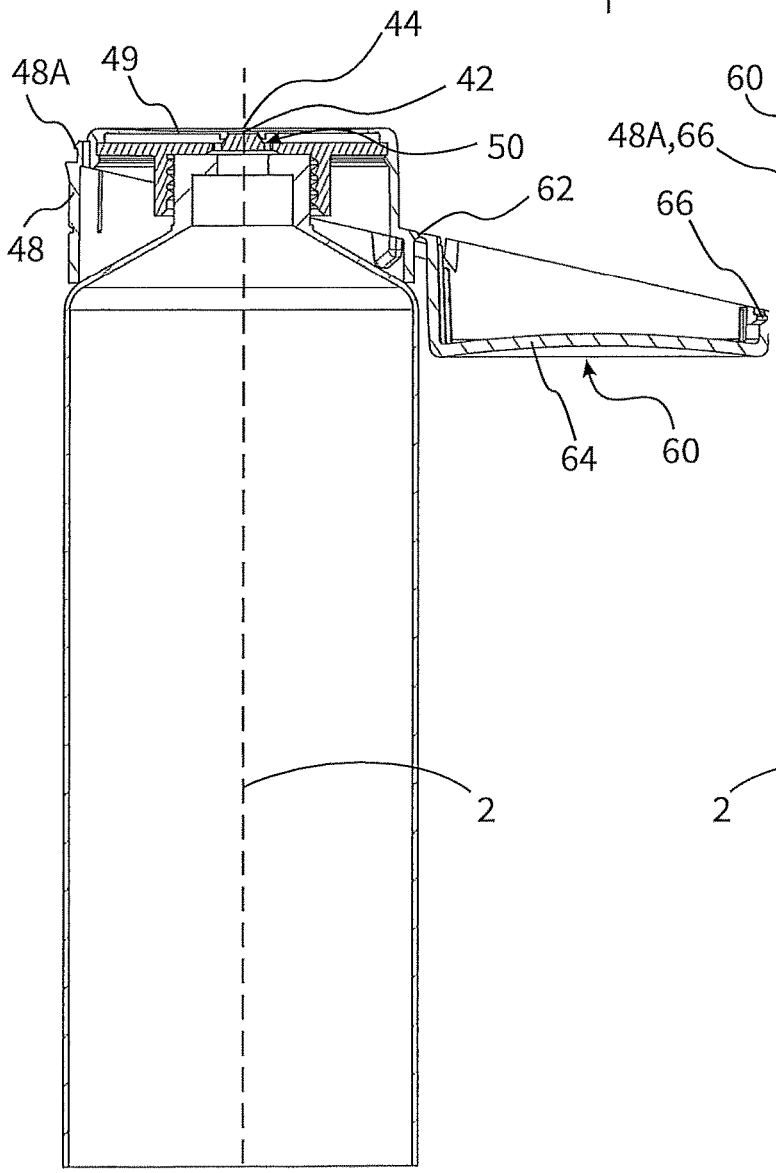

FIGS. 3 and 3A show the delivery head 20 in the ready-to-use opened state. It can be seen that the external component 40 has a casing wall 46 which at the end side is adjoined by an end wall 49. This end wall 49 is penetrated by the outlet duct 42 which opens into the delivery opening 44. The end wall 49 is configured externally so as to be almost flat and is only slightly concavely bulged. The external side is externally free of elevations or depressions such that cream that has previously been delivered to the end wall can herewith be applied from here to the skin.

The casing wall 46 in the region of the release button 48 is provided with a slot 47 which separates the release button 48 laterally and toward the top from the surrounding wall and thus permits the release button 48 to move freely.

The internal component 30 is connected to the external component 40 in order to conjointly form a valve pressure chamber 52. To this end, an outer periphery in the region of the external circumference 36A of an annular portion 36 of the internal component 30 latches into a groove on the internal side of the casing wall 46 of the external component 40. This contact region forms the fastening region 46A in the context of the invention. The connection between the external component 40 and the internal component 30 in the fastening region 46A according to the intended use is non-releasable and tight. Liquid from the liquid reservoir that reaches the valve pressure chamber 52 by way of liquid passages 33 in the internal component 30 can thus exit only through the delivery opening 44.

The outlet duct 42 which penetrates the end wall 49, as well as a valve face 34 on a frustoconical elevation which is provided so as to be centric on the internal component 30, conjointly form an outlet valve 50 which is closed on account of the slightly biased shape of the end wall 49 in the resting position. When liquid in the liquid reservoir 12 is impinged with pressure, in particular by compressing the tube, the pressurized liquid reaches the valve pressure chamber 52 and leads to the end wall 49 being deformed toward the outside. The outlet valve 50 is opened on account thereof, and the liquid can reach the external side of the end wall 49. The application directly onto the skin can take place from there once a sufficient amount of liquid has been delivered to the end wall 49.

As has already been mentioned, the delivery head 20 comprises a hinged lid 60. The latter, in the design described here, is configured as an integral part of the external component and is linked to the latter by means of an integrally configured articulation 62 in the manner of an integral hinge. Alternatively however, a design in multiple parts is also possible.

The hinged lid 60 comprises a slightly concavely bulged cover wall 64, the internal side of the latter being configured so as to be larger than the end wall 49 of the delivery head. The internal side of the cover wall 64 is surrounded by a casing wall 61 and on the inner side thereof does not have any elevations which go beyond the bulged basic shape of the cover wall 64. This leads to remnants of cream being able to be easily removed here.

Figure 4:
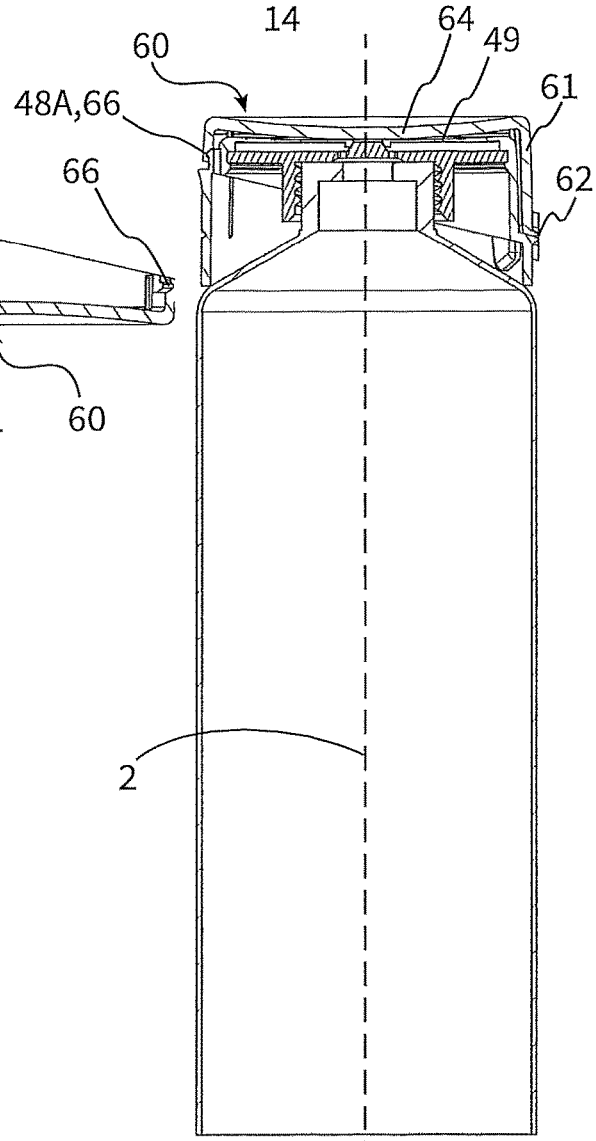
FIG. 4 shows the cream dispenser in a sectional illustration with the lid closed.

The release button 48 which has already been described is provided for opening the hinged lid 60. In the closed state which is illustrated in FIG. 4, a latching edge 48A at the distal upper end of the release button latches with a corresponding latching edge 66 on the hinged lid 60. Since the lid in the region of the cover wall 64 thereof is biased, the latching action in the closed state is rather strong, and there is no risk of any unintentional depressing of the release button 48 and of opening the hinged lid. However, this is readily possible in a manner which is pleasant in haptic terms when the release button 48 is manually and intentionally activated. The release button 48 is cut out on three sides by the slots 47 and can thus be easily depressed. Any excessive depressing action of the release button 48 is thus avoided in that the release button 48 externally impacts the fastening region 46A in the manner highlighted by the dashed lines in FIG. 3A.

The hinged lid 60 springs open as soon as the latching edges 48A, 66 have been disengaged on account of the depressing action. On account of the bias in the region of the cover wall 64 as well as on account of a suitably biased design of the articulation, the opened state of FIG. 3, in which the hinged lid 60 is pivoted by approximately 180°, can be achieved solely by pressure on the release button 48.

FIG. 3 herein highlights the relative disposal of the latching edges 48A, 66, on the one hand, and of the articulation 62, on the other hand. In terms of the direction of main extent 2 and the closed state, the articulation 62 is disposed so as to be significantly closer to the liquid reservoir 12, thus further down in the perspective of FIG. 3, than the latching edges 48A, 66. The offset, which (in terms of the direction of main extent) presently is approximately 6 mm, leads to the latching edge 66 in the opened state being spaced apart from the plane of the external side of the end wall 49 by more than double this amount, which is approximately 13 mm.

This enables the cream which previously has been delivered to the external side to be applied to the skin without the risk of the rather sharp-edged latching edge 66 contacting the skin.

The hinged lid 60, which in the closed state is under tension, by means of an internal side which forms a closure face 65 closes the delivery opening 44. This will be explained once again in more detail by means of FIGS. 5A and 5B. The internal side of the cover wall 64 in its entirety up to the lateral casing wall 61 forms a bulged closure face 65 having a largely uniform curvature radius of approximately 12 cm. The cover wall 64 has a uniform wall thickness and is also bulged in an approximately uniform manner on the entire external face 67 which is opposite the closure face 65.

Figure 5A:
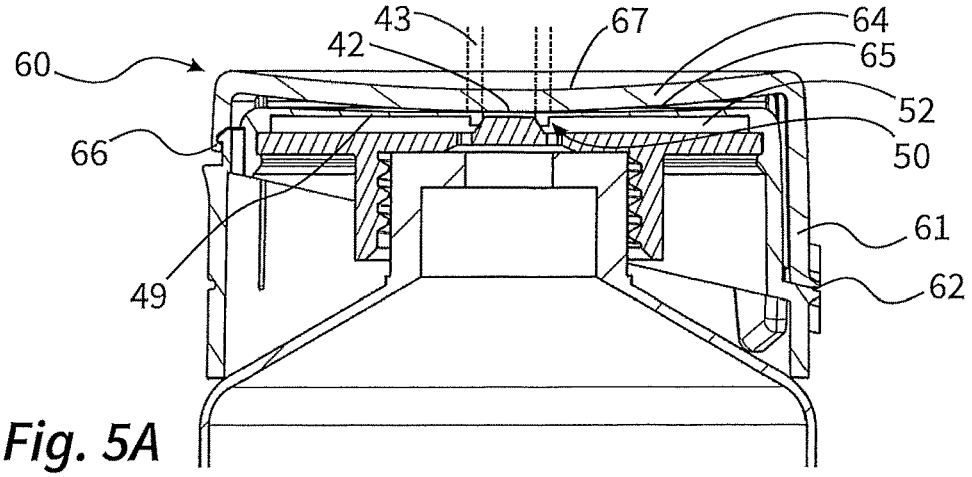
FIGS. 5A and 5B show the interaction of a hinged lid of the cream dispenser and an end face which surrounds the delivery opening for the purpose of closing the delivery opening.
Figure 5B:
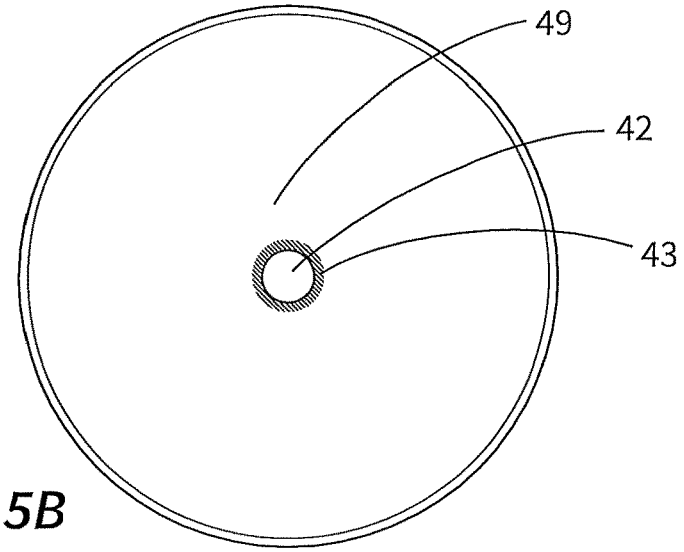

In the closed state of FIG. 5A, the closure face 65 bears on a comparatively small annular contact face 43 on the end wall 49 which is penetrated by the delivery opening 44, in addition to the outlet valve 50 thus preventing the exit of liquid. In particular, neither an unintentional compression of the tube 12 nor an increase in the pressure in the valve pressure chamber 52 can lead to liquid exiting through the delivery opening 44, since the outlet valve 50 is pushed to the closed position thereof by the closure face 65 of the cover wall 64 which is under tension.

The design of the cover wall 64 having a uniform wall thickness as well as having a bulged closure face 65, the latter forming the entire internal side of the cover wall 64, is considered advantageous in order for the desired closing tension to be achieved and for easy cleaning of the internal side to be enabled.

Figure 6:
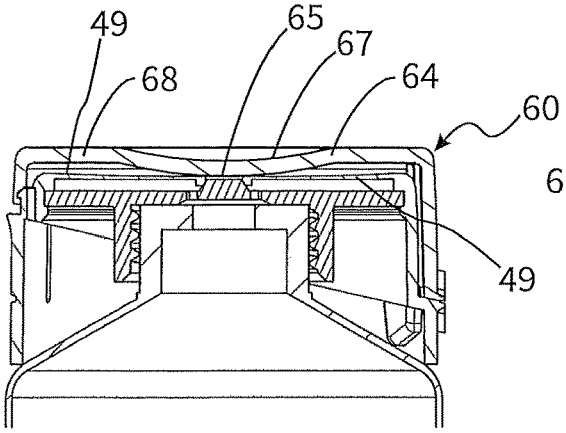
FIGS. 6 and 7 show variations of the cream dispenser of FIGS. 1 to 5B, the variations differing from the preceding design in terms of the design of the hinged lid and the closure face provided thereon.
Figure 7:
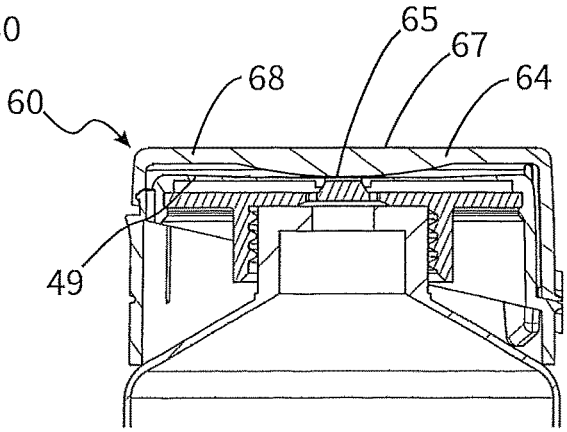

However, alternative designs in which the bulged closure face 65 only forms a centric central region of the internal side of the cover wall 64 and externally is surrounded by an annular region which is planar, for example, or bulged in the reverse manner, are also conceivable. FIGS. 6 and 7 show such designs.

Such a planar annular region 68 which forms the external region of the cover wall 64 and extends across approximately 45% of the radius is provided in the design of FIG. 6. The bulged closure face 65 is provided only internally in terms of the planar annular region 68, the bulged closure face 65 in a corresponding manner having a somewhat smaller curvature radius than the closure face of the preceding design. The curvature radius in this design is approximately 7 cm. While the cleaning of the internal side formed by the closure face 65 and the annular region 68 is not quite as easy as in the preceding design, the design according to FIG. 6 in technical terms is also advantageous in comparison to known solutions.

In the design of FIG. 7, the internal side of the cover wall 64 is shaped like in the design of FIG. 6. Deviating from the latter design, however, no uniform wall thickness is provided here. The external side of the cover wall 64 that is opposite the closure face 65 is configured so as to be planar in this design. When the hinged lid 60 is closed and bears on the end wall 49 in the region of an annular contact face 43, this leads to a deformation primarily taking place in the thinner annular region 68 which surrounds the closure face 65.

The invention claimed is:

1. A cream dispenser for topically dispensing liquids on the skin of a user, the cream dispenser comprising:

a liquid reservoir having an outlet port;

a delivery head, the delivery head comprising:

an outlet duct;

a delivery opening at an end of the outlet duct;

an end wall penetrated by the outlet duct and having an annular contact face surrounding the delivery opening, the delivery opening being provided in the end wall; and a hinged lid, the hinged lid having a closed state, the hinged lid in the closed state being positioned to close the delivery opening, the hinged lid having an outermost periphery, a cover wall bordered by the outermost periphery, the cover wall having an internal side, the internal side comprising a bulged closure face disposed in facing relation with the annular contact face of the end wall in the closed state of the hinged lid, the bulged closure face comprising a smooth and curved contoured surface free of steps and cracks, the contoured surface having a surface area larger than a cross-sectional area of the delivery opening and occupying at least 80% of a total surface area of the internal side of the cover wall, the contoured surface of the bulged closure face in the closed state of the hinged lid bearing on the annular contact face of the end wall.

2. The cream dispenser as claimed in claim 1, wherein the cream dispenser has a longitudinal dimension and the liquid reservoir includes an outlet port, the delivery head further comprising:

an outlet valve having a valve pressure chamber, the outlet valve being openable via internal pressure in the valve pressure chamber; and an internal component and an external component including the end wall, the internal component comprising a connector port extending longitudinally along the cream dispenser and connected to the outlet port, the internal component having a valve face disposed opposite an entry portion of the outlet duct, wherein the valve face and the entry portion of the outlet duct conjointly form the outlet valve and are mutually adapted such that the outlet valve is openable and closable by repositioning the valve face and the outlet duct relative to one another, the internal component and the external component, along an encircling fastening region on an internal side of a casing wall of the external component, being fixedly connected to one another such that a common interior space is formed, the common interior space forming the valve pressure chamber.

3. The cream dispenser as claimed in claim 2, wherein the hinged lid on one side thereof is provided with an articulation and opposite thereto is configured so as to have a first latching edge for fixing the hinged lid in the closed state on the external component, the external component including a release button having a second latching edge, the second latching edge, when the hinged lid is in the closed state, latching with the first latching edge and by depressing the release button being releasable from the first latching edge, and the encircling fastening region is disposed so as to be level with the release button such that the release button when activated is moved in a direction of the encircling fastening region.

4. The cream dispenser as claimed in claim 3, wherein the internal component comprises an annular portion which extends transversely to the longitudinal dimension of the cream dispenser, an external circumference of the annular portion in the encircling fastening region being fixedly and tightly connected to the external component.

5. The cream dispenser as claimed in claim 4, wherein:

the internal component comprises a material more rigid than a material of the external component; and/or the internal component, adjacent the annular portion thereof, has a wall thickness greater than a wall thickness of the end wall of the external component, the end wall and the internal component together delimiting the valve pressure chamber.

6. The cream dispenser as claimed in claim 4, wherein the internal component has a substantially flat area portion, the connector port projecting from one side of the flat area portion and an external region of the flat area portion forming the annular portion, and the flat area portion is provided with the valve face and at least one liquid passage.

7. The cream dispenser as claimed in claim 3, wherein the release button comprises a release tongue elastically molded on one side of the external component, the second latching edge being provided on a distal end of the release tongue, the release button being separated from the casing wall of the external component by a slot.

8. The cream dispenser as claimed in claim 3, wherein the hinged lid is shaped so as to bear with bias on the end wall, or the articulation is configured, such that the release button is placed under tension in the closed state and the hinged lid springs open when pressure is exerted on the release button.

9. The cream dispenser as claimed in claim 8, wherein the contoured surface of the bulged closure face is convexly-curved in a direction of the delivery opening and, in the closed state, bears with bias on the end wall.

10. The cream dispenser as claimed in claim 3, wherein the release button extends longitudinally on both sides of the encircling fastening region.

11. The cream dispenser as claimed in claim 1, wherein the contoured surface of the bulged closure face has a curvature radius between 4 cm and 25 cm.

12. The cream dispenser as claimed in claim 11, wherein the curvature radius of the contoured surface of the bulged closure face is between 6 cm and 15 cm.

13. The cream dispenser as claimed in claim 1, wherein the cream dispenser has a longitudinal dimension and the annular contact face in a radial direction has a width of less than 0.8 mm.

14. The cream dispenser as claimed in claim 13, wherein the width of the annular contact face is less than 0.4 mm.

15. The cream dispenser as claimed in claim 1, wherein the surface area of the contoured surface of the bulged closure face is at least 20% larger than the cross-sectional area of the delivery opening.

16. The cream dispenser as claimed in claim 15, wherein the surface area of the contoured surface of the bulged closure face is at least 40% larger than the cross-sectional area of the delivery opening.

17. The cream dispenser as claimed in claim 1, wherein:

the hinged lid in the closed state bears with bias on the end wall; and the hinged lid is shaped in such a manner and provided with an articulation of such a type that said hinged lid, proceeding from the closed state when said hinged lid is released, springs to a position in which the hinged lid is completely released from the end wall.

18. The cream dispenser as claimed in claim 1, wherein the contoured surface of the bulged closure face extends up to the outermost periphery of the hinged lid.

19. A cream dispenser for dispensing a liquid topically onto the skin of a user, said cream dispenser comprising:

a liquid reservoir including an outlet port for discharging the liquid;

a delivery head attached to said liquid reservoir, said delivery head comprising:

a base disposed adjacent said liquid reservoir;

an end wall connected to said base, said end wall having an outlet duct and a delivery opening at a downstream end thereof, said end wall having an annular contact surface disposed in surrounding relation with said delivery opening; and a hinged lid pivotably movable relative to said end wall between a closed state and an opened state, said hinged lid in the closed state being disposed adjacent said end wall and in the open state being spaced from said end wall, said hinged lid having an external side and an internal side facing opposite said external side, said internal side comprising a closure face, said closure face having a surface disposed in opposed and facing relation with said end wall in the closed state of said hinged lid, said surface of said closure face being convexly curved in a direction towards said end wall and being smooth and free of steps, said surface of said closure face in the closed state of said hinged lid bearing directly on said annular contact face of said end wall to close off said delivery opening.

20. The cream dispenser as claimed in claim 19, wherein said hinged lid has an outermost periphery and a cover wall bordered by said outermost periphery, said internal side of said hinged lid being formed on said cover wall, said surface of said closure face having a surface area larger than a cross-sectional area of said delivery opening and occupying a majority of a total surface area of said internal surface of said cover wall.

21. The cream dispenser as claimed in claim 19, wherein said hinged lid has a cover wall and an outer peripheral wall oriented transversely to said cover wall and fixed to an outer peripheral edge thereof, said internal side of said hinged lid being formed on said cover wall and said surface of said closure face extends up to an internal surface of said outer peripheral wall.

* * * * *